US005304089A

United States Patent [19]

Danielian

[11] Patent Number: 5,304,089

[45] Date of Patent: Apr. 19, 1994

[54] TOY SEWING MACHINE

[75] Inventor: Armen V. Danielian, Sherman Oaks, Calif.

[73] Assignee: Mattel, Inc., El Segundo, Calif.

[21] Appl. No.: 14,292

[22] Filed: Feb. 5, 1993

[51] Int. Cl.[5] ..... A63H 33/30

[52] U.S. Cl. ..... 446/474; 446/144; 446/489

[58] Field of Search ..... 446/474, 479, 144, 145, 446/246, 489; 112/258, 169, 80.03

[56] References Cited

U.S. PATENT DOCUMENTS

| | | | |
|---|---|---|---|
| D, 180,613 | 7/1957 | Neukirch . | |
| D. 190,746 | 6/1961 | Fritts . | |
| D. 192,712 | 5/1962 | Park . | |
| D. 206,013 | 10/1966 | Kuramochi . | |
| D. 211,480 | 6/1968 | Rockwell . | |
| D, 224.809 | 9/1972 | Genaro . | |
| D. 224,944 | 10/1972 | Matelet . | |
| D. 269,021 | 5/1983 | Appel et al. | D21/122 |
| D. 270,849 | 10/1983 | Balderston | D21/122 |
| 2,718,861 | 9/1955 | Samuels . | |
| 2,878,614 | 3/1959 | Argiro et al. | 446/474 |
| 3,168,849 | 2/1965 | Zilig et al. | 112/258 X |
| 3,435,789 | 10/1967 | Kuramochi | 112/169 |
| 3,443,539 | 5/1969 | Scharmer, Jr. . | |
| 3,699,705 | 10/1972 | Clarke et al. | 446/474 |
| 4,274,349 | 6/1981 | Doyel | 112/169 |
| 4,319,532 | 3/1982 | Fogarty et al. | 112/169 X |
| 5,022,323 | 6/1991 | Schultheis | 446/474 X |

FOREIGN PATENT DOCUMENTS

| | | | |
|---|---|---|---|
| 898277 | 4/1945 | France | 112/258 |
| 1170923 | 1/1959 | France . | |
| 1185877 | 8/1959 | France . | |

*Primary Examiner*—Mickey Yu
*Attorney, Agent, or Firm*—Roy A. Ekstrand

[57] ABSTRACT

A toy sewing machine includes an upper housing and a lower housing coupled by a hinge coupler. A hand crank and drive are coupled to a foot movably supported within the upper housing. A spring coupler within the drive limits the force coupled between the hand crank and the movable foot.

14 Claims, 4 Drawing Sheets

TOY SEWING MACHINE

FIELD OF THE INVENTION

This invention relates generally to toy sewing machines and particularly to those employing simulated sewing or stitching actions.

BACKGROUND OF THE INVENTION

Toy sewing machines have enjoyed great popularity for many years due in part to their capability to generally mimic or imitate the appearance and operation of actual conventional adult sewing machines. Some toy sewing machines actually impart a stitch or sewn thread line to fabric material while others simulate the sewing actions and the motions and/or sounds generally produced by sewing machines. As is the case with conventional sewing machines, toy sewing machines are available with either hand cranked mechanisms or electric motor driven mechanisms. The desire for realistic entertaining and amusing toy sewing machines has, in many instances, been truncated or limited due to the ever present requirement of maximized safety and avoidance of potential injury to the child user.

In view of the continuing popularity of toy sewing machines, a number of interesting appearance designs have been created to attract consumers. Examples of such appearance designs are found in Design Pat. No. 269,021 issued to Appel et al, Design Pat. No. 180,613 issued to Neukirch, Design Pat. No. 211,480 issued to Rockwell, Design Pat. No. 224,944 issued to Martelete, Design Pat. No. 190,746 issued to Fritts, Design Pat. No. 224,809 issued to Genaro, Design Pat. No. 206,013 issued to Kuramochi, and Design Pat. No. 192,712 issued to Park.

The toy sewing machine mechanisms have enjoyed a similar variety to that enjoyed by the appearance designs of toy sewing machines. For example, U.S. Pat. No. 5,319,532 issued to Fogarty et al sets forth a TOY SEWING MACHINE adapted to loop a strand such as yarn through sheet material such as resinous foam fabric to simulate sewing or other needlework. The overall shape of the device simulates a sewing machine and includes a platform supporting the material and a head supporting a vertically movable needle and foot.

U.S. Pat. No. 5,022,323 issued to Schultheis sets forth a PRINTING TOY SEWING MACHINE having a body portion resembling a conventional sewing machine and a printing mechanism operative for applying a printed image to a piece of sheet material in a simulated sewing action.

U.S, Pat. No. 4,274,349 issued to Doyel sets forth a TOY ELECTRIC SEWING MACHINE in which a lightweight, inexpensive toy electric sewing machine is fabricated primarily of molded plastic components and includes a battery power source supported within the sewing machine base.

U.S. Pat. No. 3,435,789 issued to Kuramochi sets forth a TOY SEWING MACHINE having a box-shaped frame supporting a pair of movable members pivotally secured and biased outwardly by a bias spring. One of the member supports a sewing platform while the other supports a downwardly facing needle. The stitching action is accomplished by squeezing the spring biased members together repeatedly to puncture the interposed fabric and provide a stitch therein.

U.S. Pat. No. 3,699,705 issued to Clarke et al sets forth a SIMULATED SEWING MACHINE TOY having a sewing machine body supporting an electric motor and a horizontally disposed shaft having a crank at one end and a driving disk at the other end. As the horizontal shaft is rotated, a needle assembly is moved in a reciprocating manner. The sewing machine utilizes a flat plastic needle having a blunt tip.

U.S. Pat. DES. 270,849 issued to Balderston sets forth a COMBINED TOY SEWING MACHINE AND CASE THEREFOR in which a pair of hinged rectangular clam shell case portions are pivotable between an open and closed position. Within the lowered clam shell member a toy sewing machine is pivotally supported by a sewing machine base to be positioned either in a horizontal position permitting closure of the case or a raised, generally perpendicular vertical position in which the sewing machine is operative.

U.S. Pat. No. 2,878,614 issued to Argiro et al sets forth a TOY SIMULATED SEWING MACHINE having a sewing machine body supporting a rotating shaft and a crank handle at one end. A movable needle head is coupled to the rotating shaft and a rotating platform is supported beneath the moving needle head.

U.S. Pat. No. 3,168,849 issued to Zilg et al sets forth a TOY PUNCH MACHINE having a housing generally representing a conventional sewing machine and supporting a rotatable shaft and hand crank. A gear and lever mechanism operates in response to shaft rotation to reciprocate a vertically oriented punch member positioned in the sewing machine-like head of the housing.

U.S. Pat. No. 3,443,539 issued to Scharner, Jr. sets forth a SEWING MACHINE having a reciprocating needle and oscillating looper driven in a prefixed phase relationship from a single powered eccentric cam arrangement.

U.S. Pat. No. 2,718,861 issued to Samuels sets forth a SEWING MACHINE having an electric drive motor and cooperating gear mechanism for reciprocally operating a sewing needle. A solenoid is operative to raise and lower the needle foot assembly.

French Patent No. 1,170,923 issued to Andreis and French Patent No. 1,185,877 issued to Pallier set forth additional sewing machine designs.

While the foregoing described devices have enjoyed some measures of success in the marketplace, there remains nonetheless a continuing need in the art for evermore improved interesting and safe toy sewing machines.

SUMMARY OF THE INVENTION

Accordingly, it is a general object of the present invention to provide an improved toy sewing machine. It is a more particular object of the present invention to provide an improved toy sewing machine which is both interesting to operate and which is completely safe for the child user.

In accordance with the present invention, there is provided a toy sewing machine which comprises an upper housing defining an upper cavity, a lower housing defining a lower cavity, a hinge coupling joining the upper and lower housings pivotable between a coplanar position and a right angle operative position, a vertically movable foot supported by the upper housing, foot drive means for moving the foot in reciprocal motion, and a spring coupler interposed between the foot drive means and the foot to limit the force coupled between the foot drive means and the foot.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
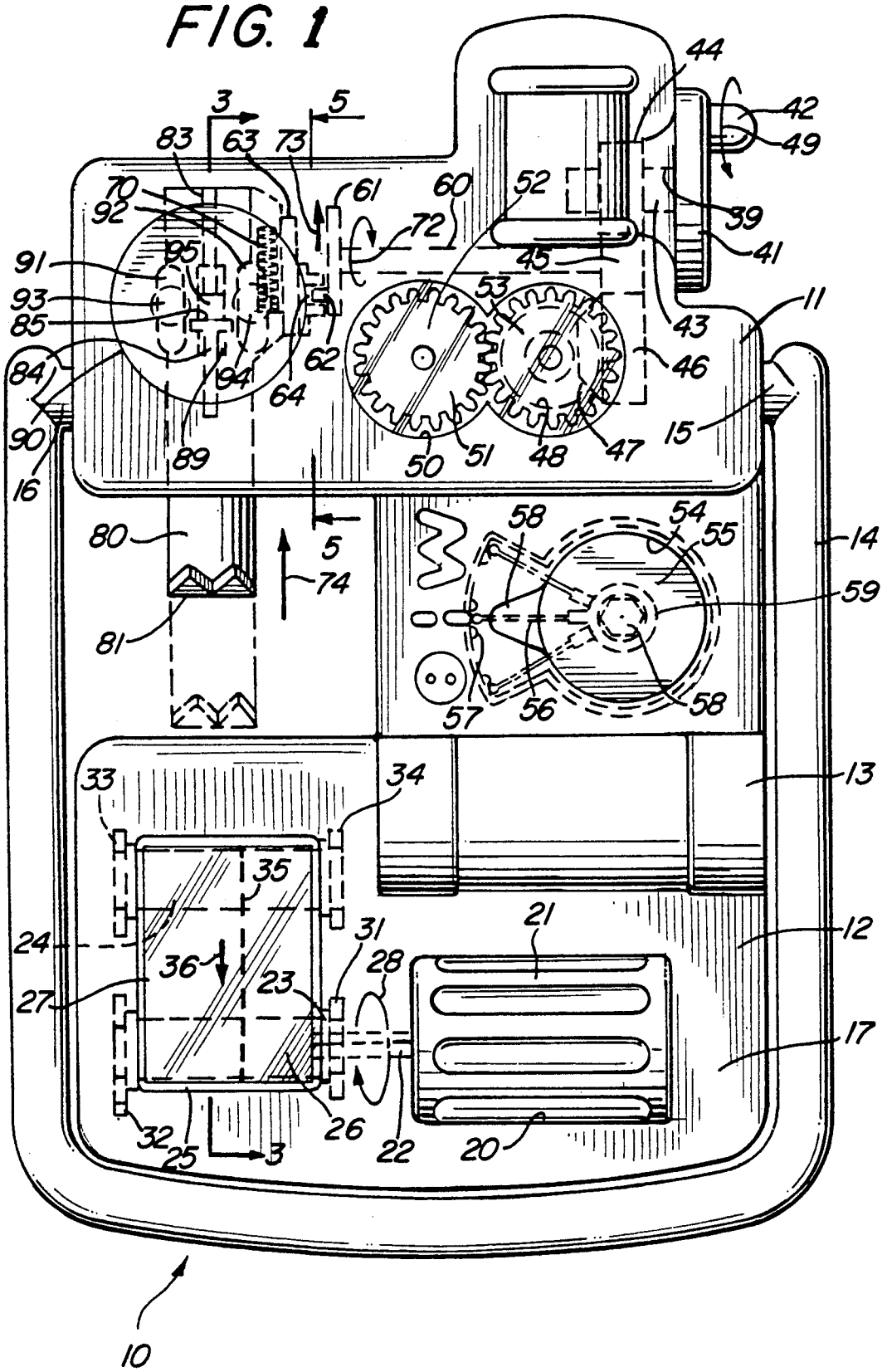
FIG. 1 sets forth a front view of the present invention toy sewing machine in its folded or flattened configuration.

FIG. 1 sets forth a front view of a toy sewing machine constructed in accordance with the present invention and generally referenced by numeral 10. Sewing machine 10 is shown in FIG. 1 in the open or carrying position and is formed of a lower housing 12 and an upper housing 11, preferably fabricated of a molded plastic material or the like, and pivotally coupled by a hinge coupler 13. With temporary reference to FIG. 2, it should be noted that lower housing 12 is movable between the flat open position shown in FIG. 1 to the operative position shown in dashed line in FIG. 2 in which lower housing is pivoted about hinge coupler 13 to be generally perpendicular to upper housing 11. Similarly, a generally U-shaped handle 14 is pivotally secured to upper housing 11 by a pair of inwardly extending post members 15 and 16. Also with temporary reference to FIG. 2, it should be noted that handle 14 is pivotable to a rearwardly extending angled position in which it supports upper housing 11 in a generally vertical orientation when lower housing 12 is moved to the operative position.

Returning to FIG. 1, it should be further noted that handle 14 may also be pivoted to the opposite position from that shown in FIG. 1 to extend upwardly above and beyond upper housing 11 and thereby provide a convenient carrying handle for carrying sewing machine 10. Hinge coupler 13 may be fabricated in accordance with conventional fabrication techniques and is preferably provided with a conventional detent mechanism (not shown) operative to provide a detent or fixed position for lower housing 12 at both the open position shown in FIG. 1 and the operative position shown in dashed line representation in FIG. 2.

Figure 3:
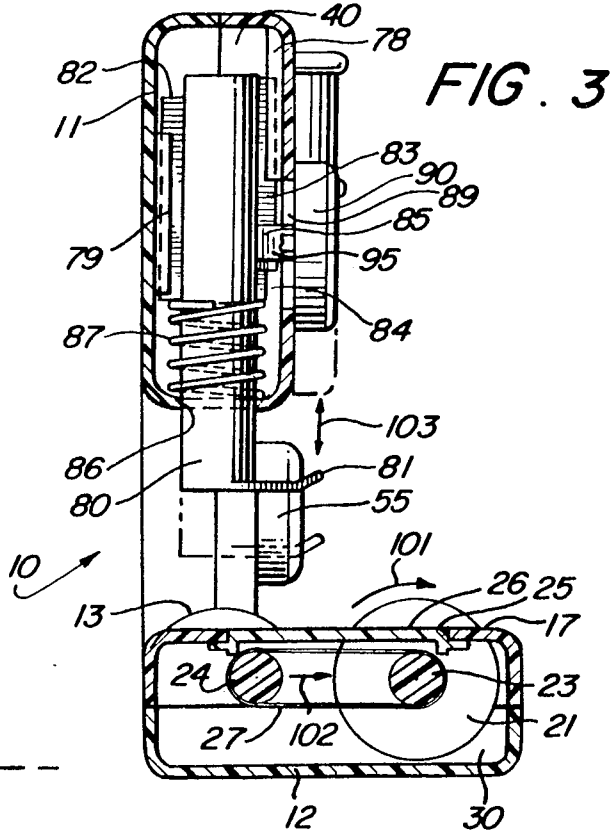
FIG. 3 sets forth a section view of the present invention toy sewing machine taken along section lines 3—3 in FIG. 1 in the folded position.

Lower housing 12 comprises a generally planar housing defining an interior cavity 30 (better seen in FIG. 3). Lower housing 12 also defines a planar upper surface 17 defining a rectangle aperture 20 and a rectangular aperture 25. A generally cylindrical roller 21 is rotatably supported within interior cavity 30 by conventional fabrication means (not shown) beneath rectangular aperture 20 such that a portion of roller 21 extends upwardly through aperture 20 to be accessible beyond upper surface 17. An elongated shaft 22 is coupled to roller 21 and extends outwardly therefrom beneath upper surface 17. A pair of generally cylindrical rollers 23 and 24 are supported in a spaced apart relationship beneath aperture 25 by a plurality of roller supports 31-34 in accordance with conventional fabrication techniques. Roller 23 is coupled to shaft 22 in a direct coupling arrangement. A fabric belt 27 formed of a flexible material, such as conventional fabric or thin plastic material or the like, is received upon rollers 23 and 24 and encircles both rollers in a substantially taut attachment. Fabric belt 27 further defines a simulated stitch marking 35 extending upon the outer surface of belt 27. A transparent window 26 covers aperture 25.

In operation, roller 21 may be rotated by the child user to produce a corresponding rotation of shaft 22 and roller 23. If, for example, roller 21 is rotated to produce rotation of shaft 22 in the direction indicated by arrow 28, a corresponding rotation of roller 23 also is produced. The belt coupling between fabric belt 27 and rollers 23 and 24 causes roller 24 and belt 27 to rotate in the direction indicated by arrow 36 which in turn causes stitch marking 35 to move beneath window 26 in the direction indicated by arrow 36. A similar but opposite operation is provided in the event roller 21 is moved in the opposite direction by the user.

Upper housing 11 defines an interior cavity 40 (shown in FIG. 3). Housing 11 defines an aperture 39 receiving a shaft 43 which in turn is coupled externally to a crank 41. Crank 41 defines an outwardly extending offset handle 42. A drive gear 44 is received upon and supported by shaft 43 within interior cavity 40. A drive shaft 60 is rotatably supported within interior cavity 40 of upper housing 11 by conventional fabrication means (not shown). A shaft gear 45 is secured to one end of drive shaft 60 and is supported in operative engagement with drive gear 44. The remaining end of drive shaft 60 is coupled to an eccentric 61 having an eccentric tab 62 extending outwardly therefrom.

Figure 8:
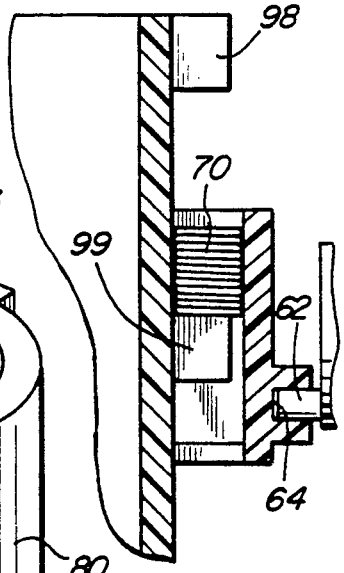

Housing 11 further defines an aperture 50 having a generally "FIG. 8" shape. Aperture 50 is covered by a transparent window 51 within which a pair of gears 52 and 53 are rotatably supported by conventional fabrication means (not shown). As is better in FIG. 4, gear 53 further supports an inwardly extending double gear 48. A coupling gear 46 is rotatably supported by conventional fabrication means (not shown) in operative engagement with shaft gear 45 and further supports an inwardly extending bevel gear 47. Bevel gear 47 engages bevel gear 48 of gear 53.

An elongated cylindrical foot 80 defines a lower cleat 81 fashioned to resemble the lower foot portion of a conventional sewing machine. Foot 80 further defines a pair of guide flanges 83 and 84 forming a gap 85 therebetween. Upper housing 11 defines an elongated center slot 89 having a pair of parallel elongated slots 91 and 92 on each side thereof. A circular knob 90 defines a pair of support posts 93 and 94 extending through slots 91 and 92, respectively, to slidably support knob 90 upon the front surface of upper housing 11. Knob 90 further defines an inwardly extending post 95 which extends through slot 89 and is received within gap 85 of foot 80. Thus, foot 80 and knob 90 are commonly movable due to the coupling between post 95 and gap 85.

A follower 63 is interposed between eccentric 61 of drive shaft 60 and foot 80 using a safety spring 70. The structure and operation of follower 63 and safety spring 70 is set forth below in greater detail in FIGS. 5–8. However, suffice it to note here that rotation of eccentric 61 produces a linear motion of follower 63 which in turn is coupled to foot 80 by spring 70 to produce a corresponding linear motion of foot 80.

Figure 2:
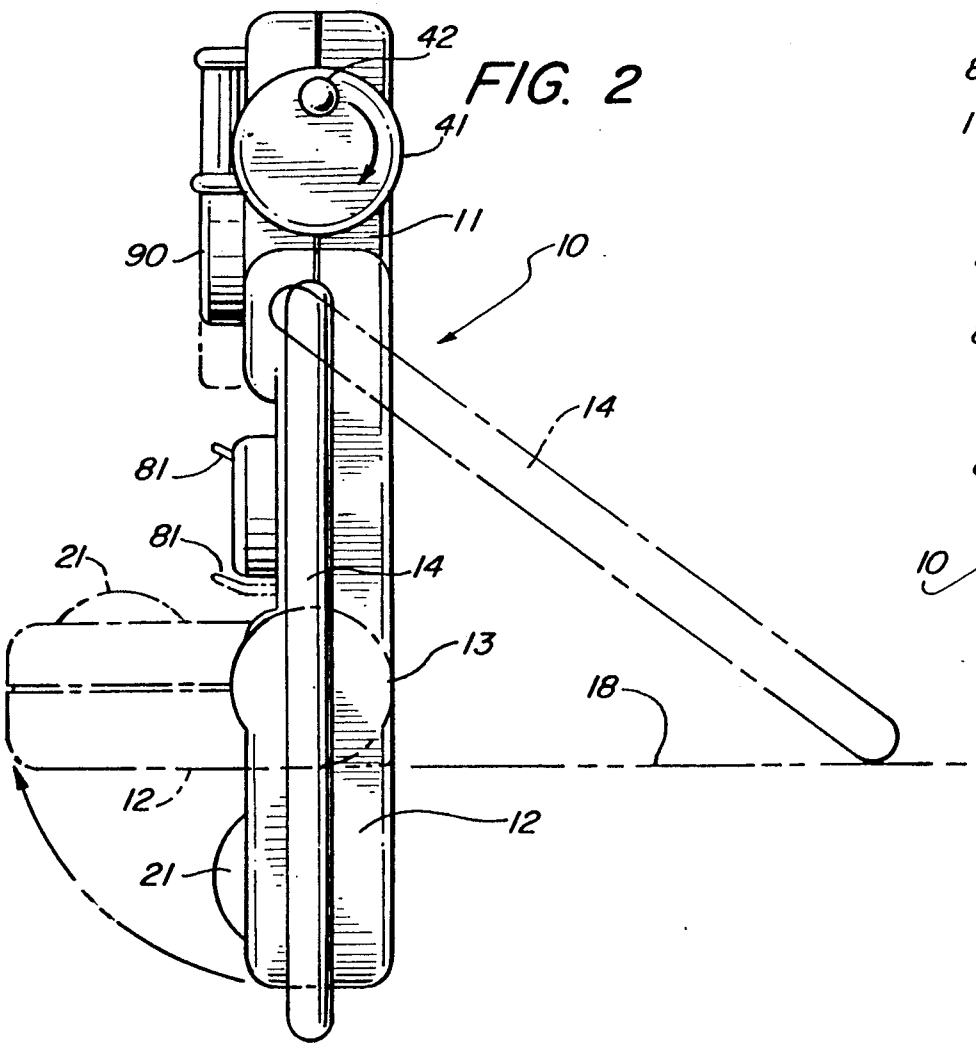
FIG. 2 sets forth a side elevation view of the present invention toy sewing machine.

In operation, toy sewing machine 10 is preferably configured in the operative position shown in dashed line representation in FIG. 2 such that lower housing 12 is generally perpendicular to upper housing 11 and such that handle 14 extends rearwardly therefrom to support upper housing 11 in a generally vertical orientation. When so positioned, the child user is then able to rotate handle 42 of crank 41 causing shaft 43 and gear 44 to be correspondingly rotated. The rotation of gear 44 is coupled to drive shaft 60 by shaft gear 45 causing a corresponding rotation of drive shaft 60 and eccentric 61 If, for example, handle 42 is rotated in the direction indicated by arrow 49, the rotation of drive gear 44 produces an opposite direction rotation of shaft gear 45 causing drive shaft 60 to rotate in the direction indicated by arrow 72. A rotation of shaft 60 and eccentric 61 raises tab 62 upwardly in the direction indicated by arrow 73. The coupling between tab 62 of eccentric 61 and channel 64 of follower 63 raises follower 63 in the direction indicated by arrow 73. The operative coupling between follower 63 and foot 80 provided by spring 70 and described below in FIGS. 5–8 in greater detail causes foot 80 to be raised upwardly in the direction indicated by arrow 74. As foot 80 is raised upwardly, the above-mentioned coupling between foot 80 provided by the extension of post 95 into gap 85 causes knob 90 to be correspondingly raised.

As the rotation of crank 41 continues, shaft 60 and eccentric 61 continue to rotate accordingly. The rotation of eccentric 61 causes tab 62 to be cyclically raised and lowered due to its offset position with respect to the center of eccentric 61. The engagement of channel 64 and tab 62 translates this eccentric motion into a linear up and down motion imparted to follower 63. The linear up and down motion of follower 63 is coupled to foot 80 and knob 90 due to the operative coupling between follower 63 and foot 80 and the extension of post 95 into gap 85. Thus, as handle 42 is continuously rotated by the child user, crank 41 is correspondingly rotated producing a continuous up and down motion of foot 80 and knob 90. In accordance with the coupling between follower 63 and foot 80 described below in greater detail, spring 70 provides a safety coupling in which the vertical movement of foot 80 is discontinued despite the continued rotation of crank 41 in the event the child user interposes an object such as the child's fingers beneath foot 80. In such case and by means described below in FIGS. 7 and 8 in greater detail, spring 70 compresses to take up the positional movement of follower 63 and absorb the force which would otherwise be applied to foot 80. As a result, the child is able to safely operate the present invention toy sewing machine without fear of injury should the child place fingers or other objects beneath foot 80.

In addition to the rotation of shaft gear 45 and drive shaft 60 produced by drive gear 45 when crank 41 is rotated, shaft gear 45 also operatively couples the rotational motion to gear 46 which in turn is coupled to gears 52 and 53 by the engagement of bevel gears 47 and 48. Thus, to provide additional interest and amusement, the child user is able to observe the meshed operation and simultaneous opposite direction rotations of gears 52 and 53 through window 51 as crank 41 continues to be rotated. Once again, the position of transparent window 51 is provided to preclude the child user from coming into potentially injurious contact with meshed gears 52 and 53 while nonetheless providing amusement and entertainment and visual enhancement of the present invention toy sewing machine.

Knob 55 is rotatably supported within interior cavity 40 of upper housing 11 by a center post 58 and a center boss 59. Knob 55 extends upwardly through aperture 54 and is accessible to the child user. A pointer 58 extends outwardly from knob 55 upon the outer surface of housing 11 and thus provides an indicating pointer for a simulated stitch selection. Knob 55 further includes an elongated resilient spring 56 extending outwardly from knob 55 within interior cavity 40 of upper housing 11. A plurality of locating projections 57 are formed within the travel path of spring 56 to provide an operative position detent tending to maintain knob 55 at a selected position. Thus the child user is able to manipulate knob 55 to provide the apparent stitch selection and further enhance the realism and entertainment value of the present invention toy sewing machine.

As a result, the present invention toy sewing machine presents the child user with a plurality of operative functions and operations together with a number of visual mechanism motions which enhance the amusement and entertainment value of the present invention toy sewing machine. The child user is able to produce movement of fabric belt 27 and observe the motion of stitch markings 35 beneath transparent window 26 using the rolling motion of roller 21. This simulates the movement of fabric material beneath the sewing machine head and, as a result, provides a realistic and yet completely safe simulation of the sewing process. Correspondingly, the rotation of crank 41 produces motion of gears 52 and 53 together with the above-described up and down motion of foot 80 and knob 90 to further simulate the sewing process a typical sewing machine. Finally, the simulation of stitch selection provided by knob 55 in its multiple position detent further enhances the realism of the present invention toy sewing machine. The entire sewing machine may be folded flat as shown in FIG. 1 or conveniently carried by handle 14 when not in use.

FIG. 2 sets forth a side view of sewing machine 10 in the open or flattened position. As described above, sewing machine 10 includes a lower housing 12 and an upper housing 11 pivotally coupled by a hinge coupler 13. As is also described above, a generally U-shaped handle 14 is pivotally secured to upper housing 11. A rotatable crank 41 includes an outwardly extending offset handle 42 and is rotatable with respect to housing 11 in the manner described above. Knob 90 is secured to foot 80 (seen in FIG. 1) which supports an extending cleat 81. A rotatable roller 21 is supported within lower housing 12 and extends outwardly therefrom to present an extending cylindrical surface.

In the position shown in FIG. 2, lower housing 12 and upper housing 11 as well as handle 14 are aligned in a common plane corresponding to the position of sewing machine 10 shown in FIG. 1. Handle 14 is pivotally movable with respect to upper housing 11 and thus may be pivoted upwardly to the opposite position of that shown in FIG. 2 to extend upwardly beyond upper housing 11 and provide a carrying handle. In the operative position of sewing machine 10, handle 14 is pivotable to the position shown in dashed line representation in FIG. 2 to provide a support for upper housing 11. Correspondingly, lower housing 12 is pivotable about hinge coupler 13 to the perpendicular position shown in dashed line representation in FIG. 2. With lower housing 12, and handle 14 pivoted to the operational positions shown in dashed line representation in FIG. 2, sewing machine 10 is ready for operation and may be conveniently placed upon a flat surface such as rest surface 18 shown in dashed line. When so positioned, the child user is able to operate crank 41 by rotating handle 42 to produce vertical motion of knob 90 and foot 80 (seen in FIG. 1). In addition, the child user is able to roll roller 21 in the manner described above to provide motion of fabric belt 27 (shown in FIG. 1). Concurrently, the manipulation of knob 55 provides a simulated stitch selection which further enhances the present invention toy sewing machine play value.

FIG. 3 sets forth a section view of sewing machine 10 taken along section lines 3—3 in FIG. 1 in which sewing machine 10 is configured in the operative position having lower housing 12 perpendicular to upper housing 11. As set forth above, toy sewing machine 10 includes an upper housing 11 pivotally coupled to a lower housing 12 by a hinge coupler 13. Lower housing 12 defines an interior cavity 30 within which a pair of rotatably supported rollers 23 and 24 extend transversely beneath a rectangular aperture 25. A transparent window 26 extends across and covers aperture 25. A generally cylindrical roller 21 is rotatably supported within interior cavity 30 by conventional support means (not shown) such that a portion of roller 21 extends beyond surface 13 and may be manipulated by a child user. A flexible belt 27, preferably formed of a fabric or thin plastic material or the like, is wound about rollers 23 and 24 in a sufficiently tight fit to maintain direct coupling between belt 27 and rollers 23 and 24. A knob 55 is supported upon upper housing 11 in the manner described above and provides a simulation of stitch selection for the child user.

Upper housing 11 defines an interior cavity 40 defining an elongated center slot 89 and a bottom aperture 86. Housing 11 further defines a generally U-shaped channel 79 and a U-shaped channel 78. Channels 78 and 79 define guide channels within which a pair of guide flanges 82 and 83 coupled to foot 80 are received in a sliding engagement which maintains the position of foot 80. Foot 80 defines a generally cylindrical member having guides 83 and 84 on the front portion thereof defining a gap 85 therebetween and guide 82 formed on the rear portion thereof. Foot 80 terminates at its bottom end in a simulated cleat 81. A return spring 87 comprising a coil spring encircles foot 80 within interior cavity 40 and is compressively captivated between the lower surface of housing 11 surrounding aperture 86 and the undersurface of guide flange 82. Thus, return spring 87 provides a spring force urging foot 80 upwardly to the raised position shown in FIG. 1.

A knob 90 defines a disk-like member having a center post 95 extending through slot 89 which is received within gap 85 between guides 83 and 84 of foot 80. Thus, knob 90 is secured to foot 80 in a direct coupling which moves knob 90 in direct association with the motion of foot 80.

In the above-described operation, the user is able to cause belt 27 beneath transparent window 26 to move in the direction indicated by arrow 102 to simulate the motion of stitched fabric material by rolling roller 21 in the direction indicated by arrow 101. An opposite direction motion is achieved by simply rolling roller 21 in the opposite direction producing a corresponding opposite direction rotation of rollers 23 and 24 and moving belt 27 correspondingly. In addition, as the user turns crank 41 (seen in FIG. 2) in the manner described above, the operative coupling also described above produces a vertical motion of foot 80 and knob 90 in the directions indicated by arrows 103.

Figure 4:
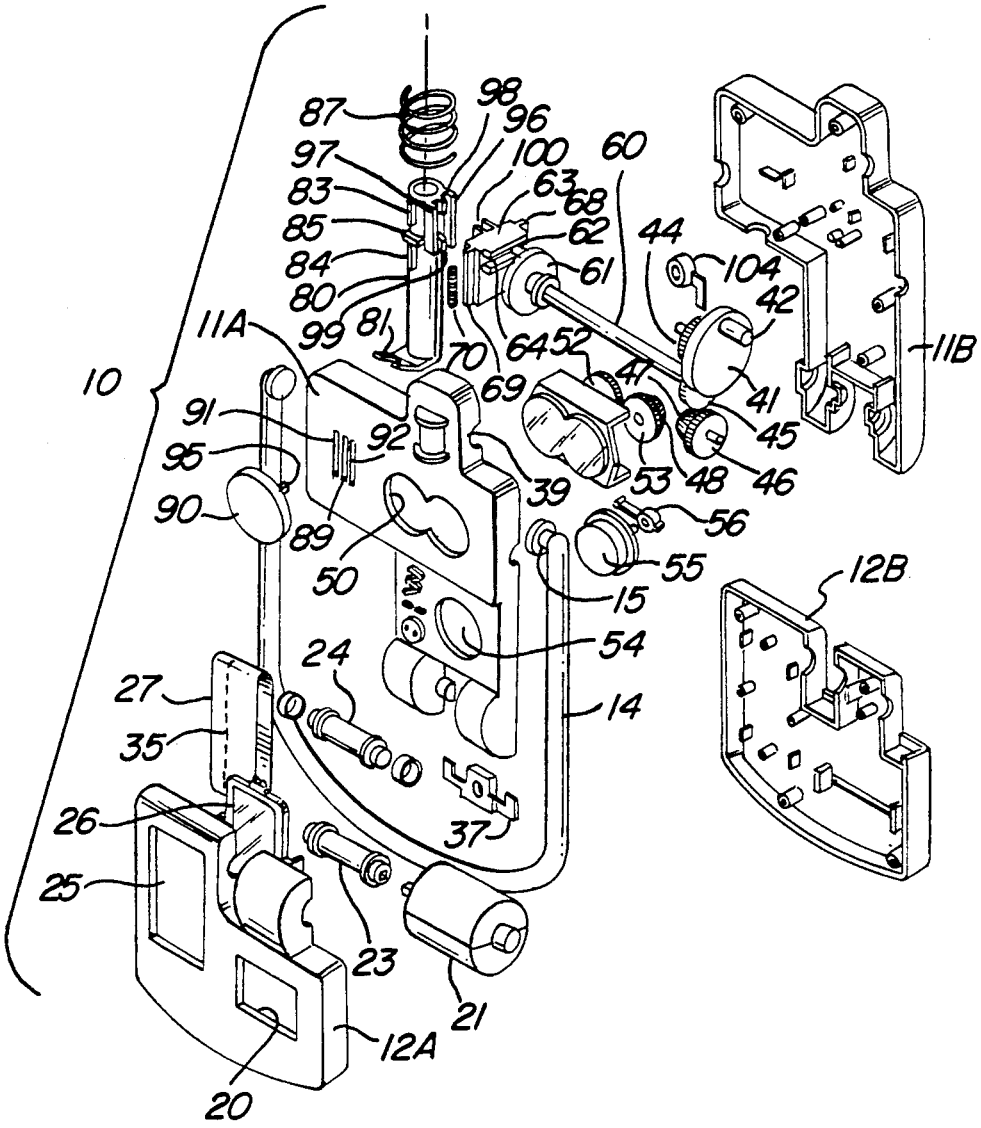
FIG. 4 sets forth a perspective assembly view of the present invention toy sewing machine.

FIG. 4 sets forth a perspective assembly view of sewing machine 10. A pair of housing portions 11*a* and 11*b* are joined to form upper housing 11 (seen in FIG. 1). Similarly, a pair of housing portions 12*a* and 12*b* are joined to form a lower housing 12 (also seen in FIG. 1). A cylinder roller 21 and a pair of rollers 23 and 24 are received and supported within the cavity formed between portions 12*a* and 12*b*. Portion 12*a* defines a pair of rectangular apertures 20 and 25. The former receives a portion of roller 21 while the latter receives a window 26. A flexible belt 27 defining a plurality of stitch marks 35 is received upon and coupled between rollers 23 and 24. Portions 12*a* and 12*b* are secured using conventional fabrication techniques such as threaded fasteners or the like. Housing portion 11*a* defines a plurality of elongated slots 91, 89 and 92 in a parallel arrangement together with an aperture 39, an aperture 50 and an aperture 54. A knob 55 is received within aperture 54 and includes a spring 56 operative to provide the above-described detent mechanism for knob 55. A window 51 is received within aperture 50 and supports a pair of rotatable gears 52 and 53. A generally U-shaped handle 14 includes a pair of inwardly extending posts 15 and 16 which are captivated between housing portions 11*a* and 11*b* to provide a pivotal attachment for handle 14. An elongated cylindrical foot 80 defines a bottom cleat 81 and a pair of aligned guides 83 and 84 defining a gap 85 therebetween. Foot 80 further defines a pair of flanges 96 and 97 having a pair of tabs 98 and 99 supported therebetween. A coil spring 87 is received upon foot 80 and provides an upward return force upon foot 80 as described above.

A follower 63 defines a spring chamber 65 (better seen in FIG. 6) which receives a coil spring 70, and a transversely extending channel 64. As is set forth below, spring 70 is received within spring chamber 65 of follower 63 after which channel 100 receives tabs 98 and 99 of foot 80 to provide a spring coupling between follower 63 and foot 80. A shaft 60 is coupled to an eccentric 61 having a tab 62 received within channel 64 at one end and a gear 45 at the remaining end. A crank 41 having a handle 42 defines a gear 44 engaging gear 45. A gear 46 is coupled to gear 45 and includes a bevel gear 47 engaging bevel gear 48.

Figure 5:
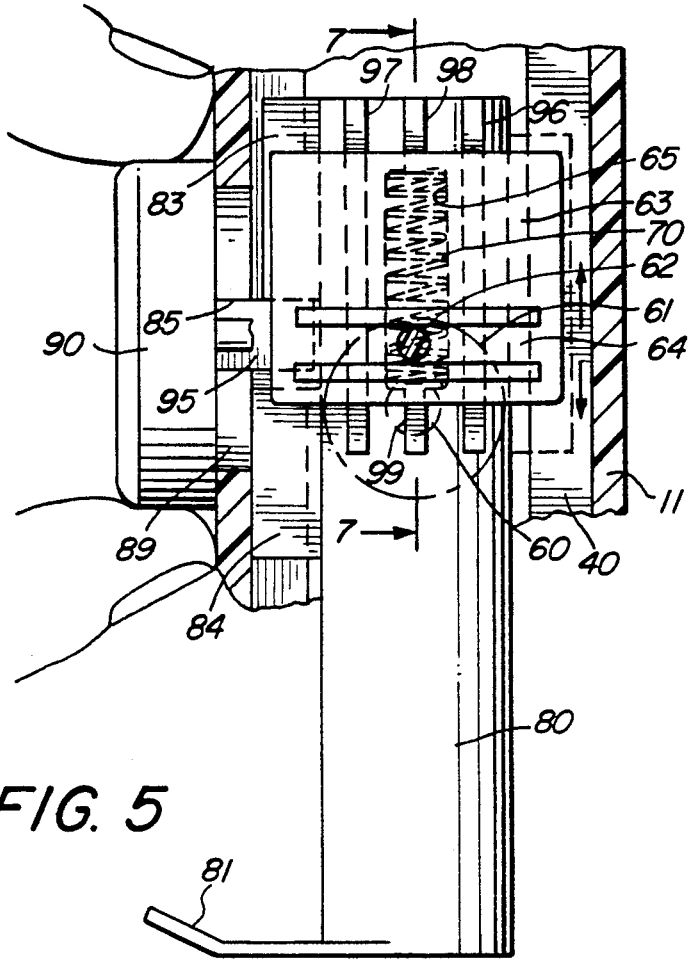
FIG. 5 sets forth a partial section view of the present invention toy sewing machine taken along section lines 5—5 in FIG. 1.

FIG. 5 sets forth a partial section view of toy sewing machine 10 taken along section lines 5—5 in FIG. 1. Foot 80 defines a lower cleat 81 and a pair of spaced apart flanges 96 and 97. A pair of tabs 98 and 99 are positioned between flanges 96 and 97. Foot 80 further defines a pair of guides 83 and 84 defining a gap 85 therebetween. Housing 11 defines an elongated slot 89 which receives post 95 of knob 90. Post 95 is received within gap 85 to couple knob 90 to foot 80. A follower 63 defines a transverse channel 64 which in turn receives tab 62 of eccentric 61. Eccentric 61 is rotatably supported by shaft 60. Follower 63 further defines a spring chamber 65 within which a spring 70 is received. Follower 63 is coupled to foot 80 such that spring chamber 65 is received between flanges 96 and 97 and such that spring 70 is captivated between tabs 98 and 99.

Thus in operation, as shaft 60 is rotated, eccentric 61 is correspondingly rotated to produce rotational motion of tab 62 which, due to the coupling of channel 64, produces reciprocating motion of follower 63. Spring 70 couples the reciprocating motion of follower 63 to foot 80 by the cooperation of tabs 98 and 99. In accordance with an important aspect of the present invention set forth below in greater detail in FIGS. 7 and 8, the use of spring 70 to couple follower 63 to foot 80 provides a safety coupling in which excessive resistive forces against the movement of foot 80, such as would occur, for example, in the event a child's finger is placed beneath cleat 81, are absorbed by the compression of spring 70 permitting eccentric 61 to continue rotating and moving follower 63. Thus, spring 70 compresses absorbing the motion of eccentric 61 and follower 63 without communicating force beyond the spring force of spring 70 to the child's finger beneath foot 80. This spring coupling, of course, in addition to providing safety advantage also preserves the operative mechanism of the present invention toy sewing machine so as to avoid damage during misuse.

Figure 6:
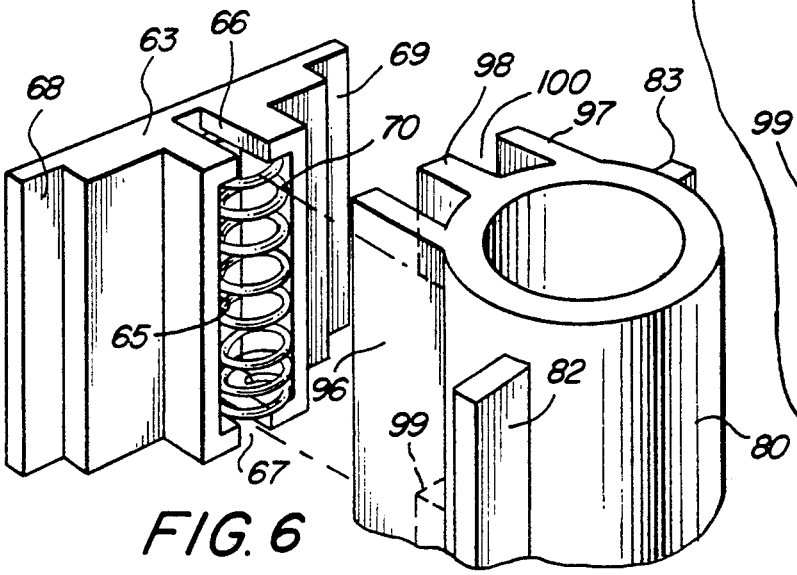
FIG. 6 sets forth a perspective assembly view of the safety spring coupling mechanism operative upon the movable foot within the present invention toy sewing machine.

FIG. 6 sets forth a perspective view of the upper portion of foot 80 and follower 63 showing the coupling of spring 70. As described above, follower 63 defines a spring chamber 65 within which spring 70 is captivated. Spring chamber 65 further defines a pair of slots 66 and 67 while follower 63 defines a pair of outwardly extending flanges 68 and 69. Flanges 68 and 69 are received within appropriately placed channels formed within interior cavity 40 (not shown) to permit sliding motion of follower 63. As described above, foot 80 defines guides 82 and 83 together with a pair of spaced apart flanges 96 and 97. Flanges 96 and 97 define a channel 100 therebetween which receives spring chamber 65 such that tabs 98 and 99 at the upper and lower ends of channel 100 are received within slots 66 and 67 of spring chamber 65. Thus as can be seen in FIG. 6, the entire force coupling between follower 63 and foot 80 is transmitted through spring 70. Spring 70 is selected to provide a spring constant which is sufficiently light to avoid transmitting potentially injurious forces from follower 63 to foot 80.

Figure 7:
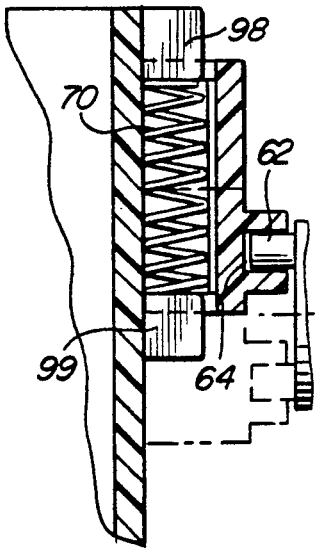
FIGS. 7 and 8 set forth section views of the safety spring coupling shown in FIG. 6 in the spring extended and spring compressed positions, respectively.

FIGS. 7 and 8 set forth section views of the safety spring coupling between follower 63 and foot 80. FIG. 7 shows a normal coupling situation in which foot 80 is not subjected to excessive resisting forces. As a result, the rotation of eccentric 61 produces rotational motion of tab 62 which is coupled through channel 64 of follower 63 to produce linear reciprocating motion of follower 63. This motion is coupled to spring 70 by spring chamber 65 and to foot 80 by tabs 98 and 99.

FIG. 8 sets forth the configuration of the safety spring coupling system in the event foot 80 encounters a significant resistance. As can be seen, a continued motion of eccentric 61 still moves tab 62 within channel 64 of follower 63. Similarly, follower 63 continues to move despite the obstruction to foot 80. The difference in motion is accommodated and injury is avoided by the compression of spring 70 which permits follower 63 to move with respect to foot 80 and thereby avoid injury to the young child.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A toy sewing machine comprising:
an upper housing defining an upper cavity;
a lower housing defining a lower cavity;
a hinge coupling joining said upper and lower housings pivotable between a coplanar position and a right angle operative position;
a vertically movable foot supported by said upper housing;
foot drive means for moving said foot in reciprocal motion; and
a spring coupler interposed between said foot drive means and said foot to limit the force coupled between said foot drive means and said foot.

2. A toy sewing machine as set forth in claim 1 wherein said foot drive means include a hand turnable crank.

3. A toy sewing machine as set forth in claim 2 wherein said foot drive means includes an eccentric rotated in response to said crank and a reciprocating follower for converting rotational motion of said eccentric to reciprocating linear motion.

4. A toy sewing machine as set forth in claim 3 wherein said spring coupler includes a compressible spring coupling said follower to said foot.

5. A toy sewing machine as set forth in claim 1 wherein said lower housing defines a first aperture and wherein said toy sewing machine further includes:
a pair of belt rollers rotatably supported within said lower cavity beneath said first aperture;
a flexible belt encircling said pair of belt rollers; and
belt drive means coupled to at least one of said rollers for moving said belt past said first aperture.

6. A toy sewing machine as set forth in claim 5 wherein said lower housing defines a second aperture and wherein said belt drive means includes a rotor within said lower cavity extending partially through said second aperture.

7. A toy sewing machine as set forth in claim 6 wherein said rotor is generally cylindrical.

8. A toy sewing machine as set forth in claim 7 wherein said foot drive means includes a gear drive.

9. A toy sewing machine as set forth in claim 7, further including a generally U-shaped handle pivotally coupled to said upper housing movable to a support position in which said handle supports said upper housing in a vertical position resting upon said lower housing in its perpendicular operative position.

10. A toy sewing machine as set forth in claim 4 wherein said lower housing defines a first aperture and wherein said toy sewing machine further includes:
a pair of belt rollers rotatably supported within said lower cavity beneath said first aperture;
a flexible belt encircling said pair of belt rollers; and
belt drive means coupled to at least one of said rollers for moving said belt past said first aperture.

11. A toy sewing machine as set forth in claim 10 wherein said lower housing defines a second aperture and wherein said belt drive means includes a rotor within said lower cavity extending partially through said second aperture.

12. A toy sewing machine as set forth in claim 11 wherein said rotor is generally cylindrical.

13. A toy sewing machine as set forth in claim 12 wherein said foot drive means includes a gear drive.

14. A toy sewing machine as set forth in claim 12, further including a generally U-shaped handle pivotally coupled to said upper housing movable to a support position in which said handle supports said upper housing in a vertical position resting upon said lower housing in its perpendicular operative position.

* * * * *